United States Patent [19]

Deering et al.

[11] Patent Number: 4,461,673

[45] Date of Patent: Jul. 24, 1984

[54] PROCESS FOR COOLING, DEPRESSURIZING, AND MOISTURIZING RETORTED OIL SHALE

[75] Inventors: Roland F. Deering, Brea, Calif.; Roland O. Dhondt, deceased, late of Long Beach, Calif., by Ruth Dhondt, executor; John E. Hines, Costa Mesa, Calif.

[73] Assignee: Union Oil Company of California, Los Angeles, Calif.

[21] Appl. No.: 400,723

[22] Filed: Jul. 22, 1982

[51] Int. Cl.[3] ..... C10B 39/04; C10B 45/00; C10B 53/06

[52] U.S. Cl. ..... 201/1; 201/39; 201/41; 208/11 R

[58] Field of Search ..... 201/1, 39, 41; 202/227; 134/21, 25.1; 208/11 R

[56] References Cited

U.S. PATENT DOCUMENTS

| | | | |
|---|---|---|---|
| 2,816,823 | 12/1957 | Galusha | 202/227 |
| 3,361,644 | 1/1968 | Deering | 208/11 R |
| 3,476,650 | 11/1969 | Peacock | 201/39 |
| 3,501,394 | 3/1970 | Lyons | 208/11 R |
| 4,004,982 | 1/1977 | Jennings et al. | 208/11 R |
| 4,083,770 | 4/1978 | Deering | 208/11 R |
| 4,100,034 | 7/1978 | Smith et al. | 201/39 |
| 4,273,617 | 6/1981 | Goedde et al. | 201/39 |
| 4,288,294 | 9/1981 | Velling | 201/39 |

OTHER PUBLICATIONS

"Synthetic Crude Oil and Transportation Fuels from Oil Shale", by Randle and Kelley, prepared for the 46th Midyear Meeting of the American Petroleum Institute's Refining Department, held May 11 to 14, 1981 in Chicago, Illinois.

"Premium Syncrude from Oil Shale using Union Oil Technology", by Miller, Harvey and Hunter, prepared for the 1982 National Petroleum Refiners Association Annual Meeting held Mar. 21 to 23, 1982, at San Antonio, Texas.

*Primary Examiner*—Bradley Garris

*Attorney, Agent, or Firm*—Dean Sandford; Gregory F. Wirzbicki; Denton L. Anderson

[57] ABSTRACT

An apparatus and process are provided for depressurizing, cooling, and, optionally, moisturizing retorted oil shale produced in an oil shale retort operated at superatmospheric pressure. Hot retorted oil shale particles are gravitated from the retort and into an elongated, multichambered vessel. In the upper chambers of the vessel the particles are partially cooled by contact with a controlled flow of liquid water. The water, having been totally vaporized, is removed from the particles at a rate which prevents the substantial flow of gases between the vessel and the retort. In the lower chambers of the vessel, the particles are first stripped of entrained hydrocarbon gas by gravitating through a countercurrently flowing stream of stripping gas and then brought to ambient pressure by gravitating through a long, narrow seal leg. Optionally, the depressurized and partially cooled particles are then further cooled and moisturized by admixing with a controlled flow of liquid water.

12 Claims, 1 Drawing Figure

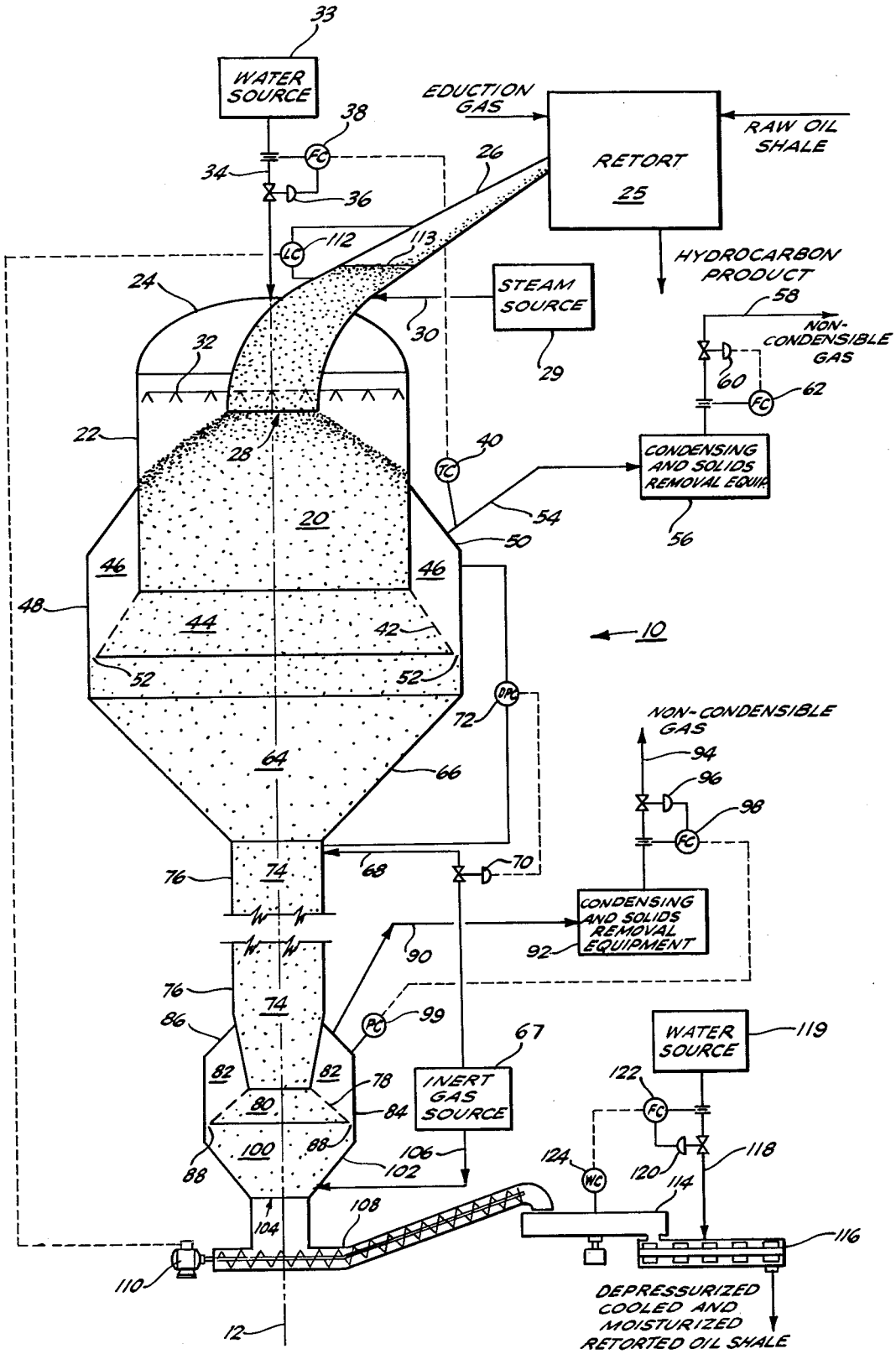
WATER SOURCE
EDUCTION GAS
RETORT 25
RAW OIL SHALE
HYDROCARBON PRODUCT
STEAM SOURCE
NON-CONDENSIBLE GAS
CONDENSING AND SOLIDS REMOVAL EQUIP.
NON-CONDENSIBLE GAS
CONDENSING AND SOLIDS REMOVAL EQUIPMENT
INERT GAS SOURCE
WATER SOURCE
DEPRESSURIZED COOLED AND MOISTURIZED RETORTED OIL SHALE

PROCESS FOR COOLING, DEPRESSURIZING, AND MOISTURIZING RETORTED OIL SHALE

BACKGROUND OF THE INVENTION

This invention relates to the extraction of hydrocarbon products from oil shale. More specifically, this invention relates to the cooling, depressurizing and moisturizing of retorted oil shale particles produced in a retorting process operated at superatmospheric pressure.

In a superatmospheric pressure retorting process, such as described in U.S. Pat. No. 3,361,644, crushed oil shale particles are passed through a retort wherein the particles are heated to between 800° and 1,100° F., typically by a countercurrently flowing stream of hot eduction gas. At these high temperatures most of the hydrocarbonaceous material within the oil shale decomposes into lighter, petroleum-like material and flows to a collecting zone where it is drawn off as shale oil and product gas. The retorting process is preferably carried out at superatmospheric pressures, typically between 10 and 50 p.s.i.g., to reduce the volume of recycled eduction gas necessary to provide the 350,000 to 450,000 Btu's per ton of oil shale typically required by the process. Retorting at superatmospheric pressures however raises the problem of how to remove processed (retorted) oil shale particles from the hot, pressurized retorting atmosphere and reduce the pressure and temperature of the particles to ambient conditions.

Conventional methods for depressurizing retorted oil shale particles have proven to be less than fully satisfactory. The use of mechanical devices such as lock vessels, solids flow control valves, and star feeders are expensive, complicated to operate, and prone to frequent failure through the rapid wearing of moving parts. In addition, such mechanical devices tend to produce an abundance of fines by the crushing and abrading of the particles. On the other hand, the use of nonmechanical hydrostatic devices leads to the undesirable liquid saturation of the particles. Such saturation causes operating problems which stem from the resultant loss of particle strength. More importantly, saturation may lead to retorted oil shale disposal problems. Retorted oil shale disposal is generally accomplished by using the particles as landfill. In constructing the landfill site, a degree of particle moisturization is desirable because such moisturization facilitates the requisite site compaction work. However particle moisturization to the point of saturation is undesirable because excess liquids will tend to gravitate out of the landfill site during the site's initial life. This devolution of landfill site material violates government regulations in many areas.

Conventional methods for cooling the retorted oil shale particles have also proven to be less than satisfactory. Such methods usually involve quenching the particles with water in such a way that the particles become undesirably liquid saturated and/or the produced steam is wasted into the atmosphere.

Accordingly, it is a major object of this invention to provide an apparatus and process for continuously removing retorted oil shale particles from a pressurized retort without resorting to mechanical sealing devices and/or hydrostatic seals.

It is a further object of this invention to provide an apparatus and process for cooling retorted oil shale particles without causing liquid saturation of the solid particles.

It is a further object of this invention to provide an apparatus and process for cooling retorted oil shale particles without having to use excessive quantities of water.

It is a further object of this invention to provide an apparatus and process for depressurizing and cooling retorted oil shale particles while avoiding particle degradation.

It is a still further object of this invention to provide an apparatus and process for imparting to retorted oil shale a controlled degree of moisturization.

These and other objects and advantages of the invention will become apparent to those skilled in the relevant art in view of the following description of the invention.

SUMMARY OF THE INVENTION

Briefly, the invention provides an apparatus and process for cooling, depressurizing, and, optionally, moisturizing hot retorted oil shale produced in an oil shale retort operated at superatmospheric pressure. The apparatus comprises (1) a cooling chamber in which is disposed a device for distributing water upon a gravitating bed of hot retorted oil shale particles, (2) a gas disengaging chamber adapted to remove gases from the gravitating particle bed, (3) a stripping chamber adapted to provide a small countercurrent flow of inert gas within the gravitating particle bed, (4) a seal leg chamber, the configuration of which is selected such that when filled with the gravitating particle bed a substantial resistance to downwardly directed gas flow is created therethrough, and, optionally, (5) a wetting device adapted to admix a controlled flow of water with the depressurized and partially cooled particles.

In the process of the invention, hot retorted oil shale particles are withdrawn from the pressurized retort and gravitated through the cooling chamber wherein they are partially cooled by contact with a controlled flow of water. From the cooling chamber the partially cooled particles are gravitated through the gas disengaging chamber wherein steam and commingled anhydrous gases are removed from the particle bed at a rate which prevents the substantial flow of gases between the cooling chamber and the retort. The particles are then gravitated through the stripping chamber wherein a countercurrent flow of inert gas strips the particles of hydrocarbon gases, carbon monoxide, hydrogen, and hydrogen sulfide thereby preventing such gases from leaking into the lower portion of the apparatus. From the stripping chamber the particle bed gravitates through the seal leg chamber to a region at a lower pressure than the pressure within the retort such as a region at atmospheric pressure. The configuration of the seal leg section prevents an excessive amount of stripping chamber gas from flowing cocurrently with the gravitating particle bed. Optionally the depressurized and partially cooled particles are next passed through a wetting device wherein the particles are admixed with a controlled flow of liquid water.

BRIEF DESCRIPTION OF THE DRAWING

The invention will be more readily understood by reference to the drawing which schematically illustrates one embodiment of the apparatus and process of the invention.

DETAILED DESCRIPTION OF THE INVENTION

The apparatus and process of this invention allow the continuous removal of hot retorted oil shale from an oil shale retort operated at superatmospheric pressure while avoiding the problems associated with prior art mechanical and hydrostatic sealing apparatus and processes. The apparatus and process provide a positive seal for the retort while minimizing degradation and excessive moisturization of the retorted oil shale particles.

Referring to the drawing, the novel apparatus of this invention includes an elongated, fluid-tight vessel, shown generally as 10, having center axis 12 and adapted to receive, pass and discharge a gravitating bed of retorted oil shale particles, preferably in mass-type ("plug flow") fashion. In a broad embodiment of the invention, vessel 10 comprises a cooling chamber, a gas disengaging chamber, a stripping chamber and a seal leg chamber. In the preferred embodiment illustrated on the drawing, the efficiency of the apparatus is increased by the addition to vessel 10 of a second gas disengaging chamber, a second stripping chamber and two gas collection chambers.

In the preferred embodiment, the uppermost portion of vessel 10 encompasses cooling chamber 20. Cooling chamber 20 is comprised of vertical first cylinder 22 fluid-tightly enclosed at the top by cooling chamber roof 24. Vessel 10 is adapted to receive a gravitating particle bed from retort 25 into the upper portion of cooling chamber 20 via retorted oil shale conduit 26. Conduit 26 preferably protrudes through roof 24 and terminates near the top of cooling chamber 20 in a downwardly directed circular opening 28 coaxially aligned with cylinder 22. In the preferred embodiment, conduit 26 is adapted to receive a stream of stripping steam from source 29 via conduit 30 at a location external of vessel 10.

Cylinder 22 is sufficiently long to provide a desired residence time for the gravitating particle bed typically between about 5 and about 30 minutes and preferably between about 8 and about 15 minutes. Cylinder 22 has a sufficiently large diameter in relationship to its height that when traversed by the gravitating particle bed little resistance to gas flow is created therethrough. Preferably the sides of cylinder 22 are inwardly tapered from top to bottom to relieve some of the solids pressure created within the lower strata of the particle bed. A taper angle between about 1° and about 5° with respect to the vertical is preferred, an angle between about 1.5° and about 3° is more preferred and an angle of about 2° l is most preferred.

Water distribution device 32, typically a plurality of water sprayers, is internally affixed within cooling chamber 20, preferably at a location above opening 28. Water distribution device 32 is adapted to contact the gravitating particle bed with a variable flow of externally stored water from source 33 via conduit 34. In the preferred embodiment, control valve 36, actuated by flow controller 38, is adapted to control the flow of water within conduit 34 in response to the temperature within gas collecting chamber 46 (hereinafter defined) as measured by temperature controller 40.

Affixed within vessel 10, immediately below cooling chamber 20, is equipment adapted to disengage gas from the gravitating particle bed. Preferably this equipment is a downwardly diverging truncated cone, adapted with slots or other apertures to allow the passage of gas while substantially preventing the passage of solids. Such a truncated cone is shown on the drawing as first truncated cone 42, the inner volume of which defines upper gas disengaging chamber 44. The smaller end of truncated cone 42 has substantially the same diameter as the lower end of cylinder 22 and is coaxially and fluid-tightly mated thereto. It is preferred that the perforated sides of truncated cone 42 diverge at an angle steeper than that of the angle of repose of the particles comprising said gravitating particle bed so that contact is always maintained between the bed and the slotted sides, thereby maintaining a stable gas disengaging particle surface. A diverging angle between about 20° and about 40° with respect to the vertical is preferable, and an angle between about 25° and about 30° is most preferable. The total void area available for gas to escape from said particle bed (in the preferred embodiment, the aggregate area of the slots in truncated cone 42) is large enough to minimize the velocity of the escaping gas, thereby minimizing the quantity of fines entrainment. Escaping gas velocities less than about 5 ft/sec are preferred, and velocities between about 2 and about 4 ft/sec are most preferred.

Outside of the slotted walls of truncated cone 42, the exterior walls of vessel 10 adjacent to truncated cone 42 enclose a first gas collecting chamber 46. First gas collecting chamber 46 is preferably a toroidal enclosure formed by first cylinder 22, truncated cone 42, second cylinder 48 and first annulus covering ring 50. Second cylinder 48 is slightly larger in diameter than the largest diameter of truncated cone 42 thereby providing an annular opening 52 between truncated cone 42 and cylinder 48. Annular opening 52 prevents a fines buildup within gas collecting chamber 46 by providing a passageway for fines to gravitate out of chamber 46 and back into the gravitating particle bed. Cylinder 48 is axially aligned with center axis 12 and is affixed in fluid-tight fashion to cylinder 22 by means of annulus covering ring 50. Annulus covering ring 50 is coaxially aligned with cylinders 22 and 48 and has a larger end and a smaller end. The larger end is the same diameter as the upper end of cylinder 48 and is coaxially and fluid-tightly mated thereto. The smaller end has substantially the same diameter as the external diameter of cylinder 22 and is coaxially and fluid-tightly mated thereto. The sides of cylinder 48 extend downwardly below truncated cone 42 for a distance sufficiently long to assure that the particle bed gravitates along the entire underside of truncated cone 42, thereby continuing to maintain a stable gas disengaging particle surface within gas disengaging chamber 44.

Condensing and solids removal equipment 56, communicating with gas collecting chamber 46 via conduit 54, is adapted to separate condensible gases (e.g., steam and heavy hydrocarbons), noncondensible gases and entrained oil shale fines from the gas mixture disengaged from the moving particle bed and gathered in gas collecting chamber 46. Conduit 58 is adapted to withdraw the noncondensible gases from condensing and solids removal equipment 56 and transport those gases to a products gas receiving facility (not shown). Control valve 60, actuated by flow controller 62, is installed within conduit 58 and is adapted to control the flow of the noncondensible gases so as to maintain a selected pressure within cooling chamber 20.

Below gas disengaging chamber 44 the exterior walls of vessel 10 taper inwardly from top to bottom to enclose first stripping chamber 64. In the preferred embodiment, stripping chamber 64 is formed by the lower portion of cylinder 48 and second truncated cone 66. The larger end of truncated cone 66 has substantially the same diameter as the lower end of cylinder 48 and is coaxially and fluid-tightly mated thereto. The sides of truncated cone 66 taper inwardly at an angle small enough with respect to the vertical to assure mass-type solids flow within said moving bed. If non-mass-type solids flow ("rat-holing") occurs within said gravitating particle bed the process is more difficult to control. Preferably the angle of taper is between about 13° and about 21° with respect to the vertical for smooth stainless steel wall surfaces, more preferably between about 15° and about 19° and most preferably about 17°. For rougher surfaces the angle of taper must be very steep (typically less than about 5° with respect to the vertical) to assure mass-type flow.

Stripping chamber 64 is adapted to receive a stream of stripping gas from source 67 via conduit 68 at a location near the base of chamber 64. Control valve 70 is adapted to control the flow of stripping gas within conduit 68. Differential pressure controller 72 is adapted to actuate control valve 70 in response to the pressure differential existing across stripping chamber 64.

Below stripping chamber 64 the exterior walls of vessel 10 enclose seal leg chamber 74. On the drawing, seal leg chamber 74 is formed by third cylinder 76. The upper end of cylinder 76 has substantially the same diameter as the smaller end of truncated cone 66 and is coaxially and fluid-tightly mated thereto. Cylinder 76 is sufficiently long and sufficiently narrow that when filled with the gravitating particle bed a substantial resistance to gas flow is created therethrough. Typically, cylinder 76 has a length-to-cross-sectional area ratio between about 4 and about 14 feet per square foot for a 15 p.s.i. differential between the gas pressures at the top and the bottom of seal leg chamber 74. It is preferred that the lower portion of third cylinder 76 is inwardly tapered from top to bottom, thereby reducing the solids pressure within the moving particle bed at points below cylinder 76. Preferably the length of the tapered portion is between about 6 inches and about 3 feet, and the angle of taper is between about 4° and about 6° with respect to the vertical.

Affixed immediately below seal leg chamber 74 within vessel 10 is additional equipment adapted to disengage gas from the gravitating particle bed. The preferred equipment is a downwardly diverging truncated cone adapted with slots or other openings to allow the passage of gas while substantially preventing the passage of solids. Such a truncated cone is shown on the drawing as third truncated cone 78, the inner volume of which defines lower gas disengaging chamber 80. The smaller end of truncated cone 78, having substantially the same diameter as cylinder 76 is coaxially and fluid-tightly mated thereto. As was the case with first truncated cone 42 described above, it is preferred that the slotted sides of third truncated cone 78 diverge at an angle steeper than that of the angle of repose of the particles comprising the moving particle bed so that contact is always maintained between the bed and the slotted sides, thereby maintaining a stable gas disengaging particle surface. A diverging angle between about 20° and about 40° with respect to the vertical is preferable. The total void area available for gas to escape from the particle bed (in the preferred embodiment, the aggregate area of the slots in diverging truncated cone 78) is, as was also the case with first truncated cone 42, large enough to minimize the velocity of the escaping gas, thereby minimizing the quantity of fines entrainment. Escaping gas velocities less than about 5 ft/sec are preferred, and velocities between about 2 and about 4 ft/sec are most preferred.

Outside of the slotted walls of truncated cone 78 the exterior walls of vessel 10 enclose a second gas collecting chamber 82. Preferably, gas collecting chamber 82 is a toroidal enclosure formed by third cylinder 76, truncated cone 78, fourth cylinder 84 and second annulus covering ring 86. Cylinder 84 is slightly larger in diameter than the largest diameter of truncated cone 78 so as to form annular opening 88 between truncated cone 78 and cylinder 84. Annular opening 88 prevents a fines buildup within gas collecting chamber 82 by providing a passageway for fines to gravitate out of chamber 82 and back into the moving oil shale particle bed. Fourth cylinder 84 is axially aligned with center axis 12 and is affixed in fluid-tight fashion to third cylinder 76 by second annulus covering ring 86. Annulus covering ring 86 is coaxially aligned with cylinders 76 and 84 and has a larger end and a smaller end. The larger end is the same diameter as the upper end of cylinder 84 and is coaxially and fluid-tightly mated thereto. The smaller end has substantially the same diameter as the external diameter of cylinder 76 and is coaxially and fluid-tightly mated thereto. The sides of fourth cylinder 84 extend downwardly below third truncated cone 78 for a distance sufficiently long to assure that the particle bed gravitates along the entire underside of truncated cone 78 thereby continuing to maintain a stable gas disengaging particle surface within second gas disengaging compartment 80.

Condensing and solids removal equipment 92, communicating with gas collecting chamber 82 via conduit 90, is adapted to separate condensible gases noncondensible gases and entrained oil shale fines from the gas mixture disengaged from the moving particle bed and gathered in gas collecting chamber 82. Conduit 94 is adapted to withdraw the noncondensible gases from condensing and solids removal equipment 92 and transport those noncondensible gases to a product gas receiving facility (not shown). Control valve 96, actuated by flow controller 98, is installed within conduit 94, and is adapted to control the flow of those noncondensible gases in response to pressure controller 99.

Below gas disengaging chamber 80 the exterior walls of vessel 10 taper inwardly from top to bottom to enclose second stripping chamber 100. Stripping chamber 100 is formed by the lower portion of cylinder 84 and hopper 102. Hopper 102 is adapted to receive the gravitating particle bed through a circular uppermost cross-section, funnel the particle bed down to a smaller cross-section, and discharge the particle bed through a bottom opening shown on the drawing as opening 104. The larger upper end of hopper 102, having substantially the same diameter as the lower end of cylinder 84, is coaxially and fluid-tightly mated thereto. The sides of hopper 102 taper inwardly at an angle small enough with respect to the vertical to assure mass-type solids flow within the gravitating particle bed. Preferably the angle of taper is between about 15° and about 20° with respect to the vertical.

Stripping chamber 100 is adapted to receive a stream of stripping gas from source 67 via conduit 106 at a location near the base of chamber 100.

In the preferred embodiment, a vessel bottom sealing conduit, adapted to transfer the particle bed at a controlled rate from opening 104 to a selected region at about atmospheric pressure while maintaining stripping chamber 100 at a slightly superatmospheric pressure less than retort pressure, is attached in fluid-tight fashion to hopper 102. On the drawing the sealing conduit is shown as screw conveyor 108 powered by variable speed motor 110. Solids level controller 112 is adapted to maintain solids level 113 within conduit 26 by varying the speed of motor 110, thereby varying the rate at which solids are removed from vessel 10 by screw conveyor 108.

In the preferred embodiment, weighing conveyor 114, adapted to transport the particle bed at a measured flow rate, is positioned to receive the particle bed from screw conveyor 108 and transport the particle bed to wetter 116.

Wetter 116, preferably a pugmill, is adapted to admix the particle bed with a controlled amount of water. In the preferred embodiment, conduit 118 is adapted to convey water from external source 119 to wetter 116. Control valve 120, actuated by flow controller 122, is adapted to control the flow of water within conduit 118 in response to solids flow rate signals from weight controller 124.

In operation, raw oil shale is contacted with a flow of heated eduction gas in retort 25. This contact, typically carried out between 10 and 50 p.s.i.g. and between 800° and 1,100° F., substantially educes hydrocarbons from the oil shale, yielding petroleum-like gas and liquid products and rock-like, substantially inorganic particles referred to herein as retorted oil shale.

In the preferred embodiment, retorted oil shale particles at a pressure on the order of 10 to 50 p.s.i.g. and a temperature on the order of 800° to 1,100° F. gravitate from retort 25 to cooling chamber 20 of vessel 10 via conduit 26. Preferably particle level 113 is maintained within conduit 26 by controlling the rate at which particles are removed from bottom opening 104 of vessel 10 by variable speed motor powered screw conveyor 108, actuated by solids level controller 112. Dry stripping steam is injected into conduit 26 via conduit 30. The stripping steam flows downwardly into cooling chamber 20 reacting with residual hydrocarbon and sulfur compounds on the cocurrently flowing retorted oil shale particles to form carbon monoxide, hydrogen, and hydrogen sulfide.

The particles flow out of conduit opening 28 and form a gravitating particle bed within cooling chamber 20. Cooling water is distributed evenly upon the top of the bed by water distribution device 32. The water is flashed to steam, reducing the retorted oil shale temperature, preferably to between about 10° and about 100° F. above the dew point of water at the pressure within cooling chamber 20. It is critical that the temperature of the partially cooled oil shale be maintained sufficiently high in cooling chamber 20 to assure that essentially all of the liquid water is flashed to steam. The shale particles are thereby kept in a dry condition, avoiding the potential problems caused by excessive wetting of the solids. Particle temperature control is typically maintained by varying the flow of cooling water to cooling chamber 20 using control valve 36 and flow controller 38, in response to the temperature of the gravitating particle bed leaving cooling chamber 20. The temperature of the bed can, in one embodiment, be measured directly using temperature probes within the gravitating particle bed. In the preferred embodiment, the temperature of the bed is indirectly measured from the temperature of disengaged cooling chamber gases as measured by temperature controller 40.

The steam produced by the distribution of cooling water upon the hot oil shale particles flows downwardly through cooling chamber 20, stripping additional hydrocarbons from the cocurrently gravitating oil shale particles. Below cooling chamber 20, this produced steam and commingled anhydrous gas flow into gas disengaging chamber 44 where they are removed from the gravitating particle bed by flowing through slotted truncated cone 42 into gas collecting chamber 46. From gas collecting chamber 46, the produced steam and anhydrous gases are removed from vessel 10 via conduit 54 to condensing and solids removal equipment 56 where condensible gases and oil shale fines are separated from the noncondensible gases.

In one embodiment of the process, pressure control in cooling chamber 20 is maintained by selectively removing the steam and anhydrous gases from vessel 10 at a rate sufficient to prevent any significant flow of gases between retort 25 and vessel 10. In another, more preferred embodiment, the pressure of cooling chamber 20 is controlled by adjusting control valve 60 on noncondensible gas conduit 58 to maintain a very small flow of eduction gas from retort 25 to vessel 10 via conduit 26.

From cooling chamber 20 the gravitating particle bed passes through gas disengaging chamber 44 and into first stripping chamber 64. A stream of inert stripping gas, preferably dry steam, is introduced near the bottom of stripping chamber 64 via conduit 68 at a pressure sufficiently high to cause a small upward flow of stripping gas within stripping chamber 64, thereby stripping residual hydrocarbons, carbon monoxide, hydrogen, and hydrogen sulfide from the void fractions within the gravitating particles. The flow of stripping gas is preferably controlled by control valve 70, actuated by differential pressure controller 72 in response to the pressure differential across gas stripping chamber 64.

From stripping chamber 64 the retorted oil shale particles gravitate through seal leg chamber 74. Seal leg chamber 74 is configured so as to substantially inhibit the downward flow of the stripping gas introduced into the first stripping chamber.

From seal leg chamber 74, the oil shale particles gravitate through second gas disengaging chamber 80 and second stripping chamber 100. Additional inert stripping gas, preferably dry steam, is introduced near the bottom of stripping chamber 100 via conduit 106 at a pressure sufficiently high to cause an upward flow of stripping gas within stripping chamber 100. This additional stripping gas and the stripping gas flowing downwardly through seal leg chamber 74 are withdrawn from the gravitating particle bed in gas disengaging chamber 80, collected in second gas collecting chamber 82 and discharged from vessel 10 via conduit 90. The gases discharged via conduit 90 are treated to remove fines, if any, and condensible gases. The resulting noncondensible gas stream is transported to a product gas receiving facility (not shown) and then either recycled as eduction gas, sold as product gas, or burned as fuel gas.

Pressure within stripping chamber 100 is maintained at a small superatmospheric pressure to prevent the influx of atmospheric oxygen into stripping chamber 100. This pressure is preferably maintained by controlling the flow of noncondensible gas through conduit 94 by control valve 96, actuated by flow controller 98 in response to the pressure within second gas collecting chamber 82 as measured by pressure controller 99.

From stripping chamber 100, the particles gravitate out of vessel 10 via bottom opening 104 to a region at atmospheric pressure by passing through screw conveyor 108 or an equivalent vessel bottom sealing conduit having at least a small resistance to gas flow.

From screw conveyor 108 the retorted oil shale particles are transported to wetting device 116 preferably via a particle flow monitoring device such as weighing conveyor 114. Within wetting device 116, the retorted oil shale particles are cooled to ambient temperature and moisturized, preferably by adding between about 10 and about 20 weight percent (dry basis) water by contact with a controlled flow of water via conduit 118. Care must be taken not to undermoisturize the oil shale, because then the oil shale may be insufficiently cooled and too hard to efficiently respond to disposal site compaction efforts. As stated above, care must also be taken not to overmoisturize the shale, because then the oil shale may lose particle strength and the excess moisture may gravitate away from the disposal site. The flow rate of water entering wetter 116 via conduit 118 is preferably controlled by control valve 120 in response to the flow of retorted oil shale particles as monitored by weight controller 124.

After being moisturized, the retorted oil shale is at ambient temperature and pressure and is ready for disposal.

The invention can be further understood by considering the foregoing specific example which is illustrative of one specific mode of practicing the invention and is not intended as limiting the scope of the appended claims.

EXAMPLE

About 5,380 tons per day of retorted oil shale is gravitated out of retort 25 via conduit 26 at about 15 p.s.i.g. and about 920° F. About 1,000 pounds per hour of dry stripping steam is injected into conduit 26 via conduit 30. The retorted oil shale and the stripping steam flow into nearly cylindrical, 14 foot tall, 13 foot 2 inch diameter cooling chamber 20 of vessel 10, forming a solids particle bed. The sides of cooling chamber 20 taper inwardly at an angle of about 2 degrees with respect to the vertical and extend downwardly to encompass a cooling chamber particle bed about 5 feet deep.

About 73,100 pounds per hour of cooling water is distributed upon the top of the particle bed by water distribution device 32. The hot retorted oil shale particles vaporize the water to steam, the particles being thereby cooled to about 275° F.

The particles gravitate through cooling chamber 20 and through gas disengaging chamber 44, formed by the sides of slotted truncated cone 42. The sides of truncated cone 42 downwardly diverge at an angle of about 28 degrees with respect to the vertical. The steam produced by the vaporization of the cooling water flows with commingled anhydrous gases through the perforated sides of truncated cone 42 and into gas collecting chamber 46, formed in part by 20 foot diameter cylinder 48. From gas collecting chamber 46 the steam and anhydrous gases flow via conduit 54 to condensing and solids removal equipment 56 at a rate of about 84,000 pounds per hour. After condensible gases and solids are removed, about 4,850 pounds per hour of noncondensible gas is recovered at about 140° F. and about 19 p.s.i.g., including about 1,580 pounds per hour of eduction gas which flows to vessel 10 from retort 25 via conduit 26.

The particle bed gravitates out of gas disengaging chamber 44 at about 275° F. and about 13 p.s.i.g. and through stripping chamber 64, formed by the lower portion of cylinder 48 and converging truncated cone 66. The lower portion of cylinder 48 extends below the lower edge of truncated cone 42 by a distance of about 4 feet to assure that the particle bed gravitates all the way to the vessel walls before entering the volume encompassed by truncated cone 66. Truncated cone 66 is clad with smooth stainless steel and converges at an angle of about 17 degrees with respect to the vertical to a diameter of about 3 feet.

About 4,950 pounds per hour of dry stripping steam is injected into the particle bed near the base of truncated cone 66 at a pressure controlled at about 2 inches of water greater than the pressure in gas disengaging chamber 44. About 1,000 pounds per hour of the stripping steam flows upwardly through stripping chamber 64 and is removed from the gravitating particle bed via gas disengaging chamber 44. The remaining 3,950 pounds per hour flows downwardly with the gravitating bed.

The particle bed gravitates out of stripping chamber 64 and through seal leg chamber 74, formed by cylinder 76. Cylinder 76 has a diameter of about 3 feet, a length of about 80 feet and a base whose lower-most 18 inches has sides which taper inwardly at an angle of about 5 degrees with respect to the vertical.

The particle bed gravitates out of seal leg chamber 74 and through second gas disengaging chamber 80, formed by the sides of slotted truncated cone 78. The sides of truncated cone 78 diverge downwardly at an angle of about 40 degrees with respect to the vertical. Gas, including the aforementioned 3,950 pounds per hour of stripping steam flowing downwardly through seal leg chamber 74, is removed from the particle bed by passing through the perforated sides of truncated cone 78 and into collecting chamber 82. From collecting chamber 82 the gas flows to condensing and solids removal equipment 92 via conduit 90. Collecting chamber 82 is formed in part by 9 foot diameter cylinder 84. Cylinder 84 mates with hopper 102 at a distance of about 3 feet below the lowest edge of truncated cone 78. The sides of hopper 102 converge at an angle of about 17 degrees with respect to the vertical.

After gravitating through second gas disengaging chamber 80 the particle bed gravitates through stripping chamber 100 formed by the lower 3 feet of cylinder 84 and hopper 102. Stripping chamber 100 is maintained at a pressure of about 8 inches of water above atmospheric pressure. The particle bed then flows out of vessel 10 to a region at about atmospheric pressure via bottom opening 104 and screw conveyor 108.

About 500 pounds per hour of dry stripping steam is injected into the particle bed near the base of stripping chamber 10. About 150 pounds per hour of this steam flows cocurrently with the gravitating particle bed and escapes to the atmosphere. The remaining 350 pounds per hour flows countercurrently through the particle bed into gas collecting chamber 82 via gas disengaging chamber 80.

The retorted oil shale particles, now at atmospheric pressure and a temperature of about 275° F., are transported from screw conveyor 108 to wetter 116. Within wetter 116 the particles are cooled to ambient temperature and moisturized to about 17 weight percent (dry basis) water by admixing with about 76,250 pounds per hour of water. From wetter 116 the particles are transported to the landfill site for disposal.

Although particular embodiments of the invention have been described including a preferred embodiment, it is evident that many alterations, modifications, and variations of the invention will appear to those skilled in the art. For instance, in the preferred embodiment illustrated on the drawing, the chambers which comprise much of the apparatus of the invention are all enclosed within a single vessel. However, some or all of the chambers could be enclosed within separate vessels as long as all such vessels were serially connected by appropriate fluid-tight conduits adapted to transport retorted oil shale particles. It is intended that the invention embrace all such alternatives, modifications, and variations as fall within the spirit and scope of the appended claims.

Having now described the invention we claim:

1. A process for cooling and depressurizing retorted oil shale particles produced from an oil shale retort operated at superatmospheric pressure, said process comprising:

(a) transferring said retorted oil shale particles from said retort to a selected location at a pressure less than the pressure within said retort by gravitating said retorted oil shale particles as a solids bed in series flow successively through a cooling chamber, a gas disengaging chamber, a stripping chamber and a seal leg chamber, the configuration of said seal leg chamber being selected to provide a substantial resistance to downwardly directed gas flow when said seal leg chamber is traversed by said gravitating particle bed;

(b) controllably contacting said oil shale particles within said cooling chamber with a selected quantity of liquid water so as to cool said particles, said quantity being selected such that substantially all of said water is vaporized to steam upon contact with said particles;

(c) selectively withdrawing gas from said gas disengaging chamber so as to maintain said cooling chamber at a pressure sufficient to prevent substantial gas flow between said cooling chamber and said retort; and (d) contacting said gravitating oil shale particles, within said stripping chamber, with an upwardly flowing stream of stripping gas.

2. The process defined in claim 1 wherein said oil shale particles are cooled within said cooling chamber by contact with said selected quantity of liquid water to between about 10° and about 100° F. above the dew point of water at the existent cooling chamber pressure.

3. The process defined in claim 1 wherein said stripping gas is dry steam.

4. The process defined in claim 1 which further comprises partially wetting oil shale particles obtained from step (a) by contacting said particles with a selected quantity of water.

5. The process defined in claim 4 wherein said selected quantity of water is chosen so as to moisturize said oil shale particles to between about 10 and about 20 weight percent (dry basis) of water.

6. A process for cooling, depressurizing and selectively wetting retorted oil shale particles produced from an oil shale retort operated at superatmospheric pressure, said process comprising:

(a) transferring said retorted oil shale particles from said retort to a selected location at about atmospheric pressure by gravitating said retorted oil shale particles as a solids bed in series flow successively through (1) a cooling chamber, (2) a first gas disengaging chamber, (3) a first stripping chamber, (4) a seal leg chamber, (5) a second gas disengaging chamber, and (6) a second stripping chamber, said seal leg chamber being selected to provide a substantial resistance to downwardly directed gas flow when said seal leg chamber is traversed by said gravitating particle bed;

(b) contacting said oil shale particles, at a location between said retort and said cooling chamber, with a cocurrent stream of stripping steam;

(c) controllably contacting said oil shale particles within said cooling chamber with a selected quantity of liquid water so as to cool said particles to between about 10° and about 100° F. above the dew point of water at the existant cooling chamber pressure, said quantity of water being selected such that substantially all of said water is vaporized to steam upon contact with said particles;

(d) withdrawing a mixture of condensible and non-condensible gas from said first gas disengaging chamber, condensing said condensible gas to produce a stream of non-condensible gas, and discharging said non-condensible gas to a product gas receiver at a selected flow rate so as to maintain said cooling chamber at a pressure sufficient to assure a small flow of eduction gas from said retort to said cooling chamber;

(e) injecting a first stream of stripping gas into said gravitating particle bed at a location near the base of said first stripping chamber so as to maintain a slightly greater pressure within the lower portion of said first stripping chamber than the lesser pressure within the upper portion of said first stripping chamber;

(f) contacting said gravitating oil shale particles within said second stripping chamber with an upwardly flowing second stream of stripping gas;

(g) selectively withdrawing gases from said second gas disengaging chamber so as to maintain said second stripping chamber at a pressure slightly above atmospheric pressure but less than the pressure within said retort; and (h) contacting oil shale particles obtained from step (a) with a selected quantity of water such that said particles are moisturized to between about 10 and about 20 weight percent (dry basis) of water.

7. The process defined in claim 6 wherein said stripping gas is dry steam.

8. The process defined in claim 1 or 6 wherein said retorted oil shale particles are gravitated as a solids bed in series flow successively through said chambers within a single elongated, substantially vertical vessel.

9. The process defined in claim 8 wherein said retorted oil shale particles are gravitated in mass-type flow within said single vessel.

10. The process defined in claim 1 or 6 wherein said seal leg chamber has a length-to-cross-sectional area ratio between about 4 and about 14 feet per square foot.

11. The process defined in claim 6 wherein the injection rate of said first stream of stripping gas is controlled in response to the difference between said greater pressure and said lesser pressure.

12. A process for cooling, depressurizing and selectively wetting retorted oil shale particles produced from an oil shale retort operated at superatmospheric pressure, said process comprising:

(a) transferring said retorted oil shale particles from said retort to a selected location at atmospheric pressure by gravitating a solids bed of said particles, within an elongated, substantially vertical vessel in mass-type fashion and serially through (1) a cooling chamber, (2) a first gas disengaging chamber, (3) a first stripping chamber, (4) a seal leg chamber, (5) a second gas disengaging chamber, and (6) a second stripping chamber, said seal leg chamber being selected to provide a substantial resistance to downwardly directed gas flow when said seal leg chamber is traversed by said gravitating particle bed and having a length-to-cross-sectional area ratio between about 4 and about 14 feet per square foot;

(b) contacting said oil shale particles, at a location between said retort and said cooling chamber, with a cocurrent stream of dry steam;

(c) controllably contacting said oil shale particles within said cooling chamber with a selected quantity of liquid water so as to cool said particles to between about 10° and about 100° F. above the dew point of water at the existent cooling chamber pressure, said quantity of water being selected such that substantially all of said water is vaporized to steam upon contact with said particles;

(d) withdrawing a mixture of condensible and non-condensible gas from said first gas disengaging chamber, condensing said condensible gas to produce a stream of non-condensible gas, and discharging said non-condensible gas to a product gas receiver at a selected flow rate so as to maintain said cooling chamber at a pressure sufficient to assure a small flow of eduction gas from said retort to said cooling chamber;

(e) injecting a stream of dry steam into said gravitating particle bed at a location near the base of said first stripping chamber so as to maintain a slightly greater pressure within the lower portion of said first stripping chamber than the lesser pressure within the upper portion of said first stripping chamber, the injection rate of said stream being selected in response to the difference between said greater pressure and said lesser pressure;

(f) contacting said gravitating oil shale particles within said second stripping chamber with an upwardly flowing stream of dry steam;

(g) selectively withdrawing gases from said second gas disengaging chamber so as to maintain said second stripping chamber at a pressure slightly above atmospheric pressure but less than the pressure within said retort; and (h) contacting oil shale particles obtained from step (a) with a selected quantity of water such that said particles are moisturized to between about 10 and about 20 weight percent (dry basis) of water.

* * * * *